US011121509B2

(12) United States Patent
Wei et al.

(10) Patent No.: US 11,121,509 B2
(45) Date of Patent: Sep. 14, 2021

(54) ELECTRICAL CONNECTOR

(71) Applicant: FCI CONNECTORS DONGGUAN LTD., Dongguan (CN)

(72) Inventors: Hua-Kun Wei, Dongguan (CN); Yi-Lin Liu, Dongguan (CN)

(73) Assignee: FCI CONNECTORS DONGGUAN LTD., Dongguan (CN)

( * ) Notice: Subject to any disclaimer, the term of this patent is extended or adjusted under 35 U.S.C. 154(b) by 0 days.

(21) Appl. No.: 16/841,364

(22) Filed: Apr. 6, 2020

(65) Prior Publication Data

US 2020/0328565 A1 Oct. 15, 2020

(30) Foreign Application Priority Data

Apr. 12, 2019 (CN) ..... 201910297005.8

(51) Int. Cl.
*H01R 13/73* (2006.01)
*H01R 13/631* (2006.01)

(52) U.S. Cl.
CPC ..... *H01R 13/73* (2013.01); *H01R 13/631* (2013.01)

(58) Field of Classification Search
CPC ..... H01R 13/73; H01R 13/631
See application file for complete search history.

(56) References Cited

U.S. PATENT DOCUMENTS 4,533,203 A * 8/1985 Feldman ..... H01R 12/714 439/626
4,693,529 A * 9/1987 Stillie ..... H01R 12/52 439/493
4,693,530 A * 9/1987 Stillie ..... H01R 12/62 439/493

(Continued)

FOREIGN PATENT DOCUMENTS

DE 91 07 627 U1 8/1991
TW D188004 S 1/2018

(Continued)

OTHER PUBLICATIONS

U.S. Appl. No. 29/687,528, filed Apr. 12, 2019, Wei et al.

(Continued)

*Primary Examiner* — Abdullah A Riyami
*Assistant Examiner* — Nader J Alhawamdeh
(74) *Attorney, Agent, or Firm* — Wolf, Greenfield & Sacks, P.C.

(57) ABSTRACT

An electrical connector, electrical connector assembly, electrical device and electrical interconnection system configured for use in electronic devices with direct connect orthogonal architectures. The electrical connector comprises: an insulating housing; at least one electrically conductive terminal, with at least a part of each of the at least one electrically conductive terminal being accommodated in the insulating housing; and a mounting flange, the mounting flange having a mounting hole for mounting the electrical connector to component PCB. A threaded connecting mem- (Continued)

ber may pass through the mounting hole and be connected to a first PCB. A portion of the mating interface part of the connector may extend below the mounting interface of the connector so as to abut an edge of the PCB. The electrical connector can simultaneously provide compactness and robustness.

32 Claims, 9 Drawing Sheets

(56) References Cited

U.S. PATENT DOCUMENTS

| | | | | |
|---|---|---|---|---|
| 5,122,064 | A * | 6/1992 | Zarreii | H01R 12/58 439/65 |
| 5,535,100 | A * | 7/1996 | Lubahn | G06F 1/184 361/752 |
| 6,848,950 | B2 | 2/2005 | Allison et al. | |
| 8,057,266 | B1 | 11/2011 | Roitberg | |
| 8,388,389 | B2 | 3/2013 | Costello et al. | |
| 8,641,432 | B2 | 2/2014 | Northey | |
| 9,153,887 | B2 | 10/2015 | Chen | |
| 9,419,356 | B2 | 8/2016 | Copper et al. | |
| 9,627,790 | B2 | 4/2017 | Anderson et al. | |
| 9,680,236 | B2 | 6/2017 | Ngo | |
| 9,780,517 | B2 * | 10/2017 | Zerebilov | H01R 11/09 |
| 9,825,384 | B2 * | 11/2017 | Kurkowski | H01R 12/7047 |
| 10,050,395 | B2 | 8/2018 | Ngo et al. | |
| 10,256,581 | B2 * | 4/2019 | Shinmi | H01R 13/73 |
| 10,276,967 | B2 | 4/2019 | Ngo | |
| 10,389,060 | B2 * | 8/2019 | Diessel | H01R 13/73 |
| 10,424,887 | B2 | 9/2019 | Hirschman et al. | |
| 10,879,647 | B2 | 12/2020 | Brungard | |
| 2008/0299838 | A1 | 12/2008 | Kopp | |
| 2009/0047814 | A1 | 2/2009 | Daamen | |
| 2009/0142953 | A1 | 6/2009 | Patel et al. | |
| 2011/0187348 | A1 | 8/2011 | Soneda et al. | |
| 2015/0009607 | A1 | 1/2015 | Daamen et al. | |
| 2015/0364878 | A1 | 12/2015 | Orris | |
| 2017/0036563 | A1 | 2/2017 | Degner et al. | |
| 2017/0214165 | A1 | 7/2017 | Brungard et al. | |
| 2018/0006414 | A1 | 1/2018 | Ooishi et al. | |
| 2018/0145463 | A1 | 5/2018 | Kiyuna et al. | |
| 2018/0309227 | A1 * | 10/2018 | Diessel | H01R 13/512 |
| 2018/0351309 | A1 * | 12/2018 | Shinmi | H01R 13/73 |
| 2019/0036422 | A1 | 1/2019 | Shirai et al. | |
| 2019/0123334 | A1 | 4/2019 | Kataoka et al. | |
| 2019/0239379 | A1 | 8/2019 | Smith et al. | |
| 2019/0288450 | A1 | 9/2019 | Brungard | |
| 2019/0288461 | A1 | 9/2019 | Kiyuna et al. | |
| 2020/0328565 | A1 * | 10/2020 | Wei | H01R 13/631 |

FOREIGN PATENT DOCUMENTS

| | | |
|---|---|---|
| TW | D192415 S | 8/2018 |
| WO | WO 93/15532 A1 | 8/1993 |

OTHER PUBLICATIONS

EP 14775056.6, Jan. 18, 2017, Extended European Search Report.
EP 14775056.6, Sep. 26, 2016, Partial Supplementary European Search Report.
TW 108306346, Jul. 1, 2020, Notice of Allowance and Search Report.
Extended European Search Report for European Application No. 14775056.6 dated Jan. 18, 2017.
Partial Supplementary European Search Report for European Application No. 14775056.6 dated Sep. 26, 2016.
Notice of Allowance and Search Report for Taiwanese Application No. 108306346 dated Jul. 1, 2019.
Wei et al., Electrical Connector, U.S. Appl. No. 29/687,528, filed Apr. 12, 2019.

* cited by examiner

ELECTRICAL CONNECTOR

CROSS-REFERENCE TO RELATED APPLICATIONS

This application claims priority to and the benefit of Chinese Patent Application No. 201910297005.8, filed on Apr. 12, 2019 and entitled "ELECTRICAL CONNECTOR." The entire contents of this application is incorporated herein by reference in its entirety.

TECHNICAL FIELD

The present patent application relates generally to an electrical interconnection system, and in particular to an electrical connector, an electrical connector assembly having the electrical connector, an electrical device having the electrical connector, and an electrical interconnection system having the electrical connector assembly.

BACKGROUND

Electrical connectors are used in many electronic systems. In general, manufacturing a system as separate electronic sub-assemblies, such as printed circuit boards (PCB), is easier and more cost-effective than manufacturing the entire system as one assembly. The separate sub-assemblies can be connected together using electrical connectors.

A known arrangement for connecting a number of printed circuit boards is to use one printed circuit board as a back plane. Other printed circuit boards (called "daughter-boards" or "daughter cards") can then be connected through the back plane. The back plane is a large PCB comprising signal traces. The signal traces carry electrical signals from one daughter card to another. The back plane is mounted at a rear part of an enclosure, and daughter cards are inserted from the front of the enclosure. The daughter cards are parallel to each other and at right angles to the back plane. To facilitate assembly, a daughter card is generally connected to the back plane through a separable connector. In general, two separable electrical connectors are used, with one of the connectors mounted to the daughter card and the other connector mounted to the back plane. These connectors mate to each other and establish a large number of electrically conductive paths. In this architecture, the back plane is mainly used to transmit signals between other circuit boards, and does not include active components for processing signals. Many conventional electrical connectors are mainly used to connect sub-cards to the back plate perpendicularly.

Another architecture for interconnecting sub-cards is direct-connect orthogonal. In a direct-connect orthogonal architecture, one or more printed circuit boards are horizontally mounted at one side of an enclosure, and one or more printed circuit boards are perpendicularly mounted at another, opposite, side of the enclosure. A horizontal edge of each circuit board on one side faces a vertical edge of each circuit board at the other side. Electronic devices that process large amounts of data at high speed, such as communication switches, may use a direct-connect orthogonal architecture, as a direct-connect orthogonal architecture can reduce the distance over which electrical signals need to be transmitted inside the device. Use of the direct-connect architecture can therefore reduce signal degradation as well as enabling a smaller system than a backplane architecture.

BRIEF SUMMARY

In some embodiments, an electrical connector is provided, comprising: an insulating housing; at least one electrically conductive terminal, with at least a part of each of the at least one electrically conductive terminal being accommodated in the insulating housing; and a mounting flange, connected to the insulating housing outside the insulating housing, the mounting flange comprising a mounting hole configured for mounting the electrical connector to an electronic component.

In some embodiments, a nut is disposed in the mounting hole.

In some embodiments, the connector has a single mounting flange.

In some embodiments, the mounting flange is disposed at a side configured to align with a printed circuit board to which a complementary electrical connector, mated to the electrical connector, is mounted.

In some embodiments, each of the at least one electrically conductive terminals has a mating contact portion and a contact tail, which extend in mutually perpendicular directions and are located at two ends of the electrically conductive terminal respectively; the contact tail extends to the outside of the insulating housing through a face of the insulating housing comprising a mounting interface.

In some embodiments, an axial direction of the mounting hole is parallel to a direction of extension of the contact tail.

In some embodiments, the contact tail has elasticity, and can be compressed when connected to an electronic component, in order to connect the contact tail to the electronic component in a press-fitted manner.

In some embodiments, the mounting flange is flush with the mounting interface, and the mounting hole is perpendicular to the mounting interface.

In some embodiments, the insulating housing comprises a main body part and an interface part connected to the main body part; the mating contact portion is accommodated in the interface part, the mounting interface is disposed on the main body part, and the interface part projects beyond the mounting interface, and is configured to abut an edge of a printed circuit board to which the electrical connector is mounted.

In some embodiments, the interface part of the insulating housing comprises: a receiving part, provided with a socket, the mating contact portions extending into the socket, and the socket is configured to receive a mating contact portion of a complementary electrical connector mated to the electrical connector; and a guiding part, disposed on the receiving part and configured to guide the complementary electrical connector during connection.

In some embodiments, the guiding part comprises a first guiding part and a second guiding part disposed opposite each other on the receiving part; and the first guiding part projects beyond the mounting surface of the insulating housing, and is configured to engage an electronic component to which the electrical connector is mounted.

In some embodiments, the interface part of the insulating housing further comprises a stabilizing part disposed on the guiding part.

In some embodiments, the insulating housing has an opening, which extends from the mounting surface to a face opposite the mating contact portions, configured to receive the at least one electrically conductive terminal through the opening.

In some embodiments, the electrical connector further comprises an organizer, the organizer having multiple insertion slots which are parallel to each other, with one electrically conductive terminal being inserted in each of the multiple insertion slots.

In some embodiments, a slot is disposed between a front end of the organizer and the insulating housing, and the slot clamps a foremost one of the at least one electrically conductive terminal.

In some embodiments, a part, close to the contact tail part, of the electrically conductive terminal is inserted into the corresponding insertion slot.

In some embodiments, each of the at least one electrically conductive terminals further comprises a first middle part connected to the mating contact portion, and a second middle part connected to the contact tail; the first middle part and the second middle part are connected to each other perpendicularly, so that the mating contact portion and the contact tail extend in mutually perpendicular directions.

In some embodiments, the organizer is stepped, with each insertion slot being located on one step; the size of each insertion slot is adapted to the size of the second middle part of the electrically conductive terminal located in front of the insertion slot, and the contact tail projects to the outside of the insertion slot.

In some embodiments, a side of the organizer is provided with a first limiting part, and a second limiting part is disposed on an inner wall of the insulating housing; the first limiting part is engaged with the second limiting part.

In some embodiments, each of the multiple insertion slots is provided with a channel on a sidewall parallel to the at least one electrically conductive terminal.

In other embodiments, an electrical connector assembly is provided, comprising any one of the electrical connectors described above and a complementary electrical connector connectable to the electrical connector.

In other embodiments, an electrical device is provided, comprising any one of the electrical connectors as described above and an electronic component electrically connected to the electrical connector.

In another aspect, an electronic device with a direct-connect orthogonal architecture is provided. The device may comprise a first electronic component and a second electronic component, and a first electrical connector mounted to the first electronic component. The first electrical connector may comprise an insulating housing; at least one electrically conductive terminal, with at least a part of each of the at least one electrically conductive terminal being accommodated in the insulating housing; and a mounting flange, connected to the insulating housing outside the insulating housing, the mounting flange comprising a mounting hole aligned with a hole in the first electronic component. A second electrical connector may be mated to the first electrical connector, wherein the second electrical connector is mounted to the second electronic component. An edge of the first electronic component is adjacent to and orthogonal to an edge of the second electronic component.

A series of concepts in simplified form have been introduced in the Summary of the invention; this will be explained in further detail in the Detailed Description of the Invention section. The Summary of the invention section does not signify an attempt to define the key features and necessary technical features of the technical solution for which protection is claimed, nor does it signify an attempt to determine the scope of protection of the technical solution for which protection is claimed.

BRIEF DESCRIPTION OF DRAWINGS

The accompanying drawings of the present invention listed below are used here, as a part of the present invention, to understand the present invention. The drawings show embodiments of the present invention and descriptions thereof, and are used to explain the principles of the present invention. In the drawings.

DETAILED DESCRIPTION

Figure 1:
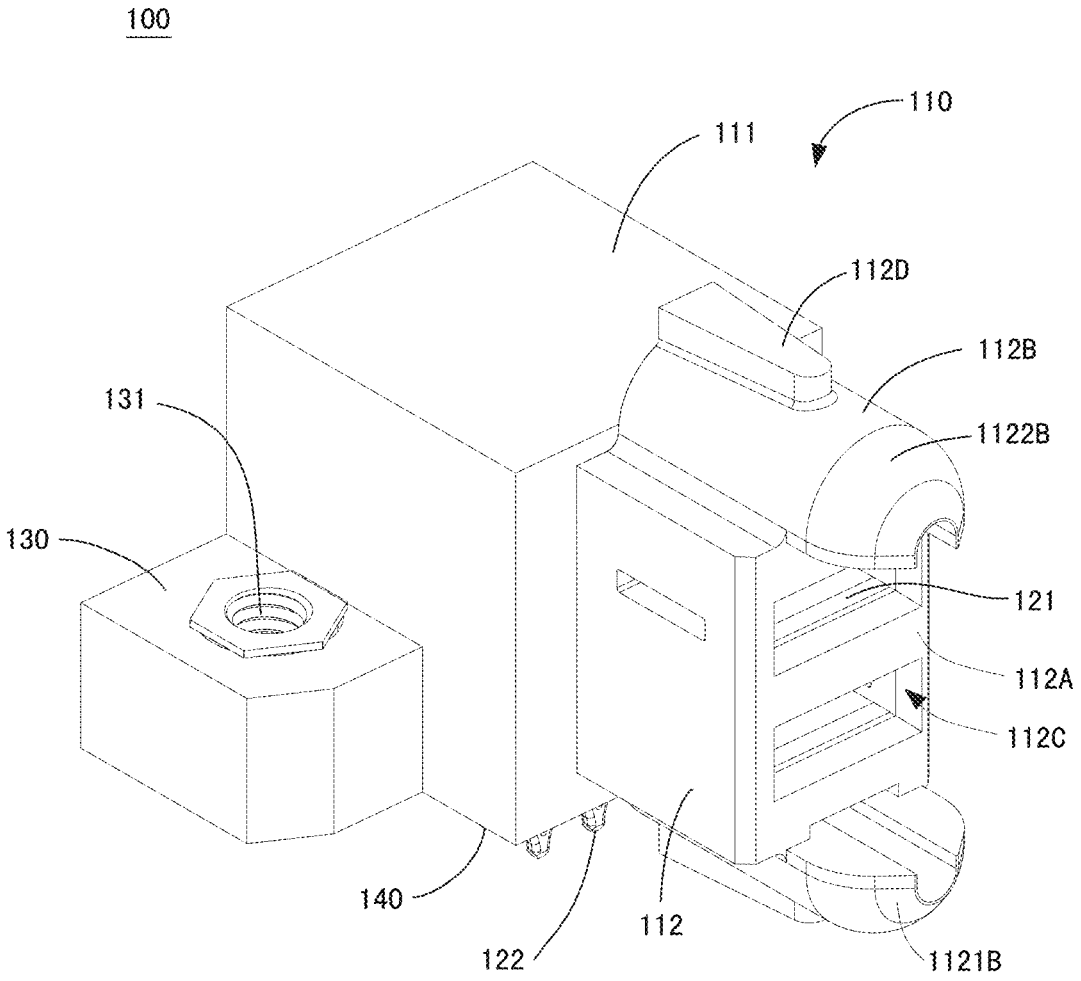
FIG. 1 is a three-dimensional drawing of an exemplary embodiment of an electrical connector for use in an electronic device with a direct-connect orthogonal architecture.

The inventors have recognized and appreciated designs for electrical connectors that enable reliable transmission of power between printed circuit boards in a direct-connect orthogonal architecture. Such connectors are configured for robust mounting to a printed circuit board, with small separation between adjacent parallel boards, enabling reliable operation of compact electronic devices.

In the following description, a large number of details are provided in order to enable a thorough understanding of the present invention. However, those skilled in the art will understand that the following description shows illustrative embodiments of the present invention. The present invention can be implemented without the need for one or more of such details. In addition, in order to avoid confusion, some technical features which are well known in the art are not described in detail.

Various features and technologies described herein may be used alone or in any suitable combination to improve the performance of an interconnection system. The features and technologies described herein may be particularly beneficial in an electronic device with a direct-connect orthogonal architecture. Using electrical connectors using these technologies, the electrical connectors may be reliably and firmly connected to electronic subassemblies, such as printed circuit boards, and thereby establish reliable and firm electrical connections in an electronic device with a direct-connect orthogonal architecture.

In a system with a direct-connect orthogonal architecture, one or more printed circuit boards may be horizontally mounted in the rear of an enclosure, and one or more printed circuit boards may be perpendicularly mounted in the front of the enclosure. A horizontal edge of each circuit board located in the rear faces a vertical edge of each circuit board in the front of the enclosure. Electrical connectors are used to achieve orthogonal interconnection of these printed circuit boards, wherein each printed circuit board may have an electrical connector mated to an electrical connector of another printed circuit board. However, the structure in which the PCBs located in the rear are horizontal while the PCBs located in the front are vertical is merely demonstrative. The electric connector described herein may be used in any electronic device in which the mutually facing edges of the PCBs are orthogonal and electrical connections are made at the orthogonal edges.

This type of direct-connect orthogonal architecture may be used, for example, in a network switch. The horizontal PCB may serve as a processor, for processing signals received from a network. The vertical PCB may serve as a line card; each line card may be coupled to a different cable used to carry network information. The direct-connect orthogonal architecture enables information from any one of these cables to be coupled to the board with the processor where it may be processed, and then sent to another cable for transmission.

Figure 9:
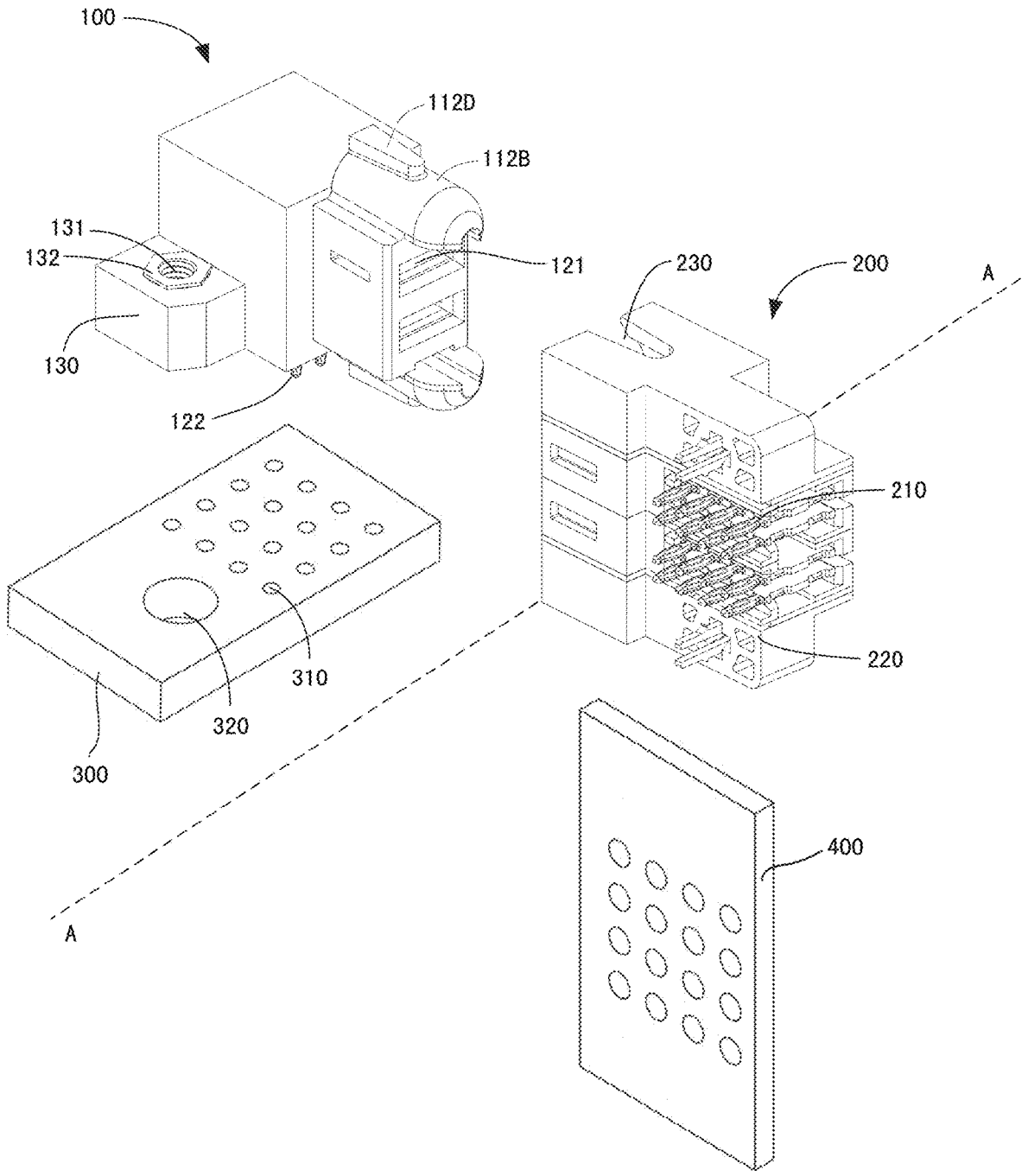
FIG. 9 is an exploded view of a portion of an electronic device with a direct-connect orthogonal architecture including the electrical connector of FIG. 1 and a mating electrical connector.

For clarity of description, an electrical connector mated to the electrical connector of the present invention is called a complementary electrical connector herein. In some embodiments, one of two electrical connectors which are mated to each other may be a plug electrical connector, and the other may be a receptacle electrical connector. The two electrical connectors which are mated to each other may be used for transmitting electric power between circuit boards connected to them in the direct-connect orthogonal architecture. FIG. 9 shows the intersection of one horizontal board and one vertical board where two electrical connectors are mated to each other, i.e. an electrical connector 100 and a complementary electrical connector 200.

As can be seen in the example of FIG. 9, connector 200 has a mating interface with an elongated dimension parallel to a printed circuit board 400 to which it is mounted. Connectors used in systems with a right angle architecture similarly have such an orientation. Accordingly, connector 200 may be a connector of known design such as is used on a daughter card in an electronic device with a right angle architecture. Connector 100, in this example, has a mating interface with an elongated dimension perpendicular to a printed circuit board 300 to which it is mounted. Connector 100 may be configured for robust mounting in a compact system using a direct-connect orthogonal architecture. FIGS. 1-7 show an electrical connector 100 in an embodiment of the present invention.

Figure 7:
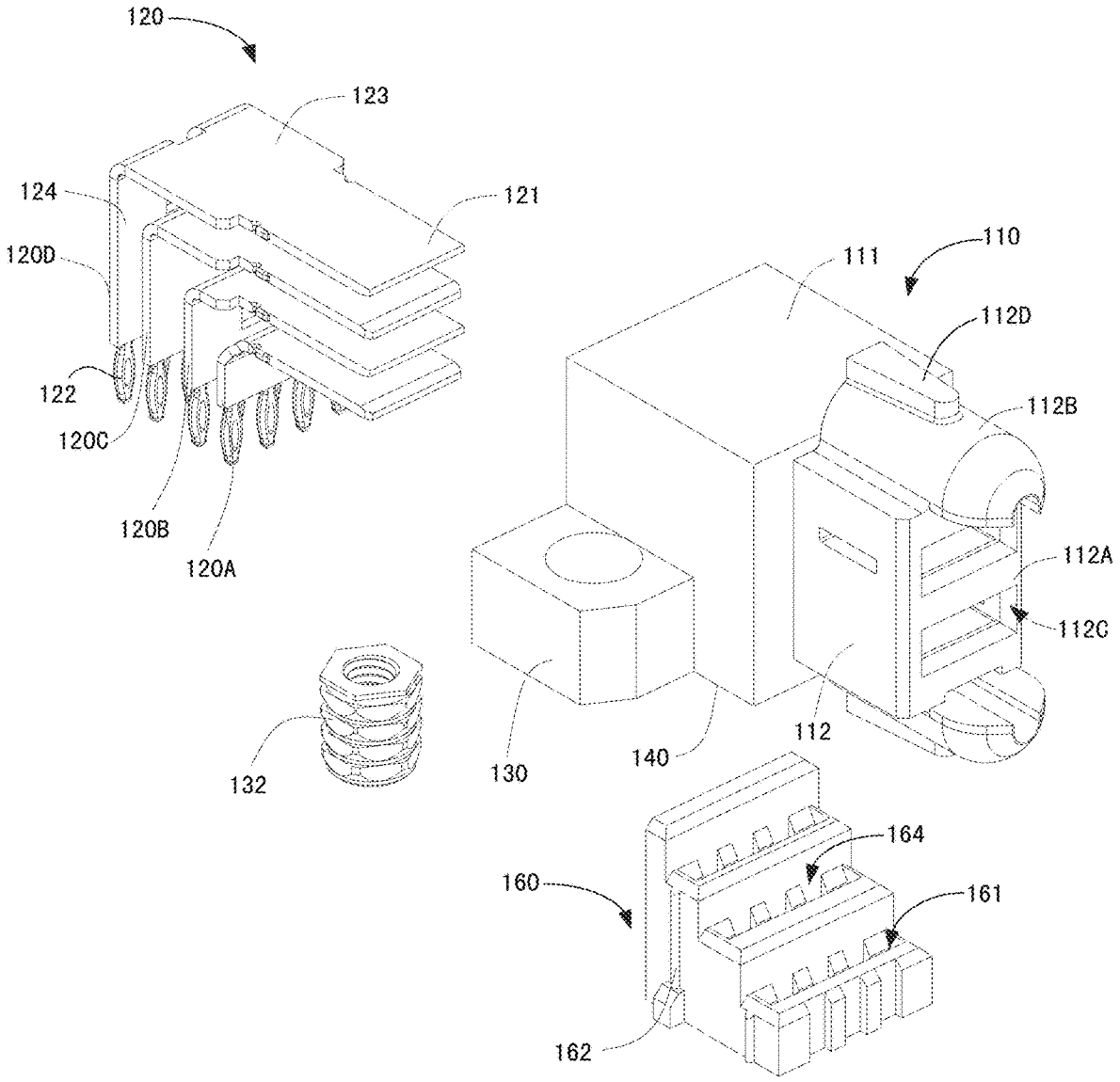
FIG. 7 is an exploded view of the electrical connector of FIG. 1.

As shown in FIG. 7, the electrical connector 100 comprises an insulating housing 110 and a set 120 of at least one electrically conductive terminal. The insulating housing 110 may be molded from an insulating material. The insulating material for example may comprise a plastic having glass fiber, to reinforce the strength of the plastic. An internal cavity may be molded inside the insulating housing 110. The cavity may accommodate at least a part of the electrically conductive terminals in set 120.

The set 120 of electrically conductive terminals for example may comprise multiple electrically conductive terminals 120A, 120B, 120C and 120D as shown in FIG. 7. At least a part of each electrically conductive terminal in the set 120 may be accommodated in the insulating housing 110; see in particular FIGS. 1-2 and FIGS. 4-5. Each electrically conductive terminal of the set 120 has a mating contact portion 121 and a contact tail 122, located at two ends of the electrically conductive terminal respectively. The mating contact portion 121 is configured to be electrically connected to a mating contact portion of the complementary electrical connector 200. In this example, the mating contact portions 121 are within the housing, such that connector 100 is configured as a receptacle connector, but other configurations may be employed. The contact tail 122 may be configured to be electrically connected to a first PCB 300, as shown in FIG. 9. In this example, the contact tails 122 are configured as press-fits. The electrically conductive terminal 120 is used for transmitting current.

In the illustrated embodiment, a number of holes 310 are disposed on the first PCB 300. The holes 310 are attached to an electrically conductive structure in the first PCB 300, which may serve as "power planes". When the electrical connector 100 is mounted onto the first PCB 300, the contact tail 122 is inserted into the hole 310, and is thereby electrically connected to the power planes. The contact tails 122 of one or more electrically conductive terminals may be attached to the same power plane or different power planes.

In order to be electrically connectable to the hole 310, the contact tail 122 extends to the outside of the insulating housing 110. A face of housing 110, through which the contact tails 122 extend may form a mounting interface 140. Each contact tail 122 may be press-fitted into a hole 310. When the contact tail 122 is pressed into the hole 310 of the first PCB 300, the contact tail 122 is compressed. Compression can form an outward force on a sidewall of the hole 310, and thereby form a reliable electrical connection between the contact tail 122 and the hole 310, and can also give rise to a force which retains the electrical connector 100 on the first PCB 300, thereby helping to perform a reliable electrical connection between the electrical connector 100 and the first PCB 300. In the illustrative embodiment of FIG. 4, the contact tail 122 has a flat ring shape. A longitudinal direction of the flat ring shape is substantially parallel to an insertion direction. In the process of inserting the contact tail 122 into the hole 310, a transverse dimension of the flat ring shape is squeezed by the sidewall of the hole 310 and becomes smaller, and the contact tail 122 is thereby compressed. The contact tail 122 may also have other shapes. For example, the contact tail 122 may be constructed to enable soldering to a surface of the first PCB 300, or soldering in the hole 310 of the first PCB 300.

The mating contact portion 121 and the contact tail 122 extend in mutually perpendicular directions. For clarity of description, it is specified that the mating contact portion 121 extends towards a region in the front of the electrical connector 100, and the contact tail 122 extends towards a region below the electrical connector 100. With this nomenclature, a face of the insulating housing 110 that faces the complementary electrical connector 200 is a front face, and a face where the contact tails 122 are located is a bottom face.

The mating contact portion 121 may be accommodated in the insulating housing 110. In this case, the electrical connector 100 may be a receptacle electrical connector. Alternatively, the mating contact portion 121 may project to the outside of the insulating housing 110, and be matched and connected to the complementary electrical connector 200, so that the electrical connector 100 serves as a plug electrical connector.

A mounting flange 130 is connected to the insulating housing 110, outside the insulating housing 110. The mounting flange 130 may be disposed at a side of the insulating housing 110. The mounting flange 130 is provided with a mounting hole 131. The mounting hole 131 is used for mounting the electrical connector 100 to the first PCB 300, as shown in FIG. 9. In the illustrated embodiment, the first PCB 300 may be provided with a circuit board hole, such as through-hole 320. When the electrical connector 100 is electrically connected to the first PCB 300, for example when the contact tail 122 of the electrical connector 100 is inserted into the hole 310, the mounting hole 131 in the mounting flange 130 is aligned with the circuit board through-hole 320 in the first PCB 300. Thus, the electrical connector 100 can be reliably mounted on the first PCB 300 by means of a threaded connecting member (not shown). The threaded connecting member may comprise a bolt and a nut; the bolt is connected to the nut after passing through the circuit board through-hole 320 and the mounting hole 131, thereby mounting the electrical connector 100 to the first PCB 300.

Preferably, a nut 132 is disposed in the mounting hole 131. The nut 132 is fixed in the mounting hole 131. In this way, the bolt is screwed into the nut 132 in the mounting hole 131 after passing through the circuit board through-hole 320 in the first PCB 300, and can thereby mount the electrical connector 100 reliably on the first PCB 300. The electrical connector 100 can thereby be fixed more conveniently to the first PCB 300. Optionally, if the mounting flange 130 has sufficient mechanical strength, an internal thread could also be provided directly in the mounting hole 131. In general, the mounting flange 130 is made integrally with the insulating housing 110, for example from a material such as plastic, which may include, for example, glass fiber for reinforcement.

The electrical connector 100 provided in embodiments of the present invention can simultaneously have the advantages of compactness and robustness. In general, it is very difficult to achieve these two advantages simultaneously, because if a device is made compact, then the strength of the connector is likely to be impaired, so that it is susceptible to mechanical damage. However, the electrical connector 100 provided in embodiments of the present invention, through the provision of the mounting flange having the mounting hole, can allow the threaded connecting member to pass through the mounting hole and be connected to the first PCB 300, thereby increasing the reliability of connection. This type of threaded connection structure is especially able to resist a twisting force of the first PCB 300 relative to the electrical connector 100. Although the first PCB 300 is drawn very small in FIG. 9 for simplicity, in actual applications the PCBs included in interconnected electrical systems are much larger than the electrical connector 100, therefore twisting forces may be substantial.

Preferably, an axial direction of the mounting hole 131 is parallel to a direction of extension of the contact tail 122. The contact tail 122 is inserted downward into the hole 310 of the first PCB 300. The first PCB 300 is in close contact with the mounting interface 140 of the insulating housing 110. The first PCB 300 is perpendicular to the direction of extension of the contact tail 122. Thus, the mounting hole 131 may extend in a direction perpendicular to the first PCB 300.

Preferably, the insulating housing 110 only comprises one mounting flange 130. The direct-connect orthogonal system can thereby be made smaller and more compact. The mounting flange 130 may be disposed at a side of the insulating housing 110. The side of the insulating housing 110 is a face that is connected to both the front face and the bottom face of the insulating housing 110.

Preferably, the mounting flange 130 is flush with the mounting interface 140 of the insulating housing 110. In the embodiment shown in the figure, a lower surface of the mounting flange 130 is flush with the mounting interface 140. Thus, when the electrical connector 100 is mounted to the first PCB 300, the first PCB 300 can be in close contact with the mounting interface 140 of the insulating housing 110 and the lower surface of the mounting flange 130. In this way connector 100 is securely mounted on the first PCB 300. The mounting hole 131 in the mounting flange 130 is perpendicular to the mounting interface 140. In this way, the threaded connecting member can be perpendicularly connected to the first PCB 300 when passed through the mounting hole, facilitating their connection.

Optionally, the mounting interface 140 may project beyond a bottom face of the mounting flange 130, such that when the electrical connector 100 is mounted to the first PCB 300, there will be a certain gap between the first PCB 300 and the bottom face of the mounting flange 130; this allows a cushioning component such as a spacer to be added in the gap (if necessary).

A connection structure of the electrical connector 100 and the first PCB 300 has been described above with reference to FIG. 9, e.g. a threaded fastener is passed through the circuit board through-hole 320 of the first PCB 300 and the mounting hole 131 of the mounting flange 130, and the contact tail 122 of the electrically conductive terminal 120 is inserted into the hole 310 in the first PCB 300. The electrically conductive terminal 120 is thereby electrically connected to the power plane in the first PCB 300. With regard to the complementary electrical connector 200 which is mated to the electrical connector 100, a conventional electrical connector may be used, as long as the mating contact portion 121 of the electrically conductive terminal 120 can be matched and connected thereto. The complementary electrical connector 200 also contains at least one electrically conductive terminal. The quantities and structures of the electrically conductive terminals of the complementary electrical connector 200 and the electrical connector 100 may be matched to each other. The electrically conductive terminal of the complementary electrical connector 200 also has a mating portion and a contact tail part 210. Due to the angle, only the contact tail part 210 is shown in FIG. 9.

The contact tails 210 of the complementary electrical connector 200 may be connected to a second PCB 400 in a manner similar to that of the first PCB 300 as described above for example. Once the complementary electrical connector 200 and the electrical connector 100 have been mated, the mating portions of the two connectors are electrically connected, so that current is transmitted between the first PCB 300 and the second PCB 400.

As shown in FIG. 9, a mounting interface 220 of the complementary electrical connector 200 is perpendicular to the mounting interface 140 of the electrical connector 100, and the horizontal first PCB 300 is thereby electrically connected to the vertical second PCB 400. In the direct-connect orthogonal system, it is possible that multiple electrical connectors 100 and multiple complementary electrical connectors 200 are placed side by side in the direction shown by line A-A in FIG. 9. In this case, each of the multiple complementary electrical connectors 200 which are placed side by side might be electrically connected to one vertically extending second PCB 400. The second PCB 400 has a certain thickness, and will occupy a certain amount of space; therefore, it is preferred that the mounting flange 130 may be disposed at a side where the second PCB 400 connected to the complementary electrical connector 200 is located. It is possible for no mounting flange 130 to be disposed at another side opposite said side. In other words, the mounting flange 130 of the electrical connector 100 is arranged substantially opposite the second PCB 400 of the complementary electrical connector 200 connected to the electrical connector 100. Thus, gaps between second PCBs 400 can be made small, the and the device with a direct-connect orthogonal architecture can be made more compact or a greater number of PCBs can be interconnected while ensuring that the volume of the electronic device does not change.

Returning to refer to FIGS. 1-7, the insulating housing 110 comprises a main body part 111 and an interface part 112. The interface part 112 is connected to the main body part 111. The interface part 112 is in front of the main body part 111. In some exemplary embodiments, the interface part 112 comprises a receiving part 112A and a guiding part 112B, as shown in FIGS. 1 and 7. The receiving part 112A is provided with a socket 112C. The mating contact portion 121 of the electrically conductive terminal 120 is accommodated in the interface part 112. The mating contact portion 121 extends into the socket 112C. The socket 112C is used for receiving the mating contact portion of the complementary electrical connector 200 which is mated to the electrical connector 100. In the embodiment shown in FIG. 1, the interface part 112 is provided with two sockets 112C. The present invention does not restrict the number of sockets 112C; in order to electrically connect the electrical connector 100 to a greater or smaller number of power planes on the first PCB 300, the mating contact portion 121 may be provided with a greater or smaller number of sockets 112C. In the illustrated embodiment, two matching-connecting parts 121 are disposed in each socket 112C. Each mating contact portion 121 is in close contact with a top wall or a bottom wall of the socket 112C. In some embodiments, two electrically conductive terminals in the set 120 corresponding to each socket 112C will be electrically connected to the same power plane. However, since each electrically conductive terminals in set 120 is electrically insulated, there is no need for two electrically conductive terminals 120 in the same socket 112C to be electrically connected to the same power plane. In other embodiments, two electrically conductive terminals 120 in each socket 112C may be electrically connected to different power planes. The different power planes may be connected to different voltages.

The guiding part 112B is disposed on the receiving part 112A, and used for guiding the complementary electrical connector 200 when the electrical connector 100 is connected to the complementary electrical connector 200, so that the electrical connector 100 and the complementary electrical connector 200 are aligned, and the mating contact portions of the two connectors can be electrically connected. In the embodiment shown in the figure, the guiding part 112B substantially has the shape of a half-cylinder formed by a flat surface and a curved surface. The flat surface is connected to the receiving part 112A. An axis of the half-cylinder extends in a direction of insertion of the complementary electrical connector 200. In addition, a near end (with respect to the complementary electrical connector 200) of the half-cylinder gradually narrows, in order to achieve better alignment with the complementary electrical connector 200 in the process of insertion. Correspondingly, the complementary electrical connector 200 is provided with a part matched to the guiding part 112B, e.g. an opening which complements the shape of the guiding part 112B. Preferably, guiding parts 112B are disposed in a pair on the receiving part 112A, with each pair of guiding parts 112B being arranged opposite each other on the receiving part 112A. For example, as shown in the figures, paired guiding parts 112B are disposed on an upper surface and a lower surface of the receiving part 112A. However, the present invention is not limited to this. Alternatively or additionally, paired guiding parts 112B may be disposed on a left side and a right side of the receiving part 112A.

The mounting interface 140 of the insulating housing 110 is disposed on the main body part 111. The contact tail 122 of the electrically conductive terminals of set 120 passes through the mounting interface 140 from inside the main body part 111 and extends to the outside of the insulating housing 110. In the illustrated embodiment, each electrically conductive terminal 120 further comprises a first middle part 123 connected to the mating contact portion 121, and a second middle part 124 connected to the contact tail 122, as shown in FIG. 7. The first middle part 123 and the second middle part 124 are perpendicularly connected to each other, so that the mating contact portion 121 and the contact tail 122 extend in mutually perpendicular directions. In the illustrated embodiment, the first middle part 123 and the second middle part 124 are accommodated in the main body part 111. The mating contact portion 121 extends into the interface part 112 from the main body part 111, and specifically, extends into the socket 112C of the interface part 112. The contact tail 122 projects to the outside of the main body part 111. Each of the electrically conductive terminals of set 120 may be integrally formed. As an example, the electrically conductive terminals may be formed by punching from metal sheet. Each electrically conductive terminal of set 120 may be punched and then bent to form a structure of the mating contact portion 121 at one end and the contact tail 122 at another end. The metal is for example copper or an alloy thereof, in order to be able to have a low resistance, and can also have sufficient elasticity, so that the contact tail 122 can be pressed into a through-hole of the PCB. If necessary, the various parts of the electrically conductive terminals of set 120 could also be formed separately, and then connected together by a process such as welding.

In the illustrated embodiment, the interface part 112 projects beyond the mounting interface 140 on the main body part 111, such that it may extend beyond an edge of a printed circuit board 300 to which connector 100 is mounted. A surface of the interface part 112 which faces the mounting interface 140 can serve as an abutment surface 150. When the electrical connector 100 is mounted to first PCB 300, a top face (in the arrangement position of FIG. 9) of the first PCB 300 is in close contact with the mounting interface 140, and an edge of the first PCB 300 can abut the abutment surface 150, see FIG. 2. Such an engagement between the abutment surface 150 and the edge of the first PCB 300 limits motion of the connector 100 relative to PCB 300. This limiting action can play a beneficial role in the mounting process of electrical connector 100 to the first PCB 300. Alternatively or additionally, once the electrical connector 100 has been mounted to the first PCB 300, the abutment surface 150 can also provide mechanical support for holding the mounting interface 140 of the electrical connector 100 on the first PCB 300. For example, the abutment interface may resist a moment on connector about the mounting interface 140 that might occur during mating of a connector 200 with connector 100. Such a moment may be large because of the vertical orientation of connector 100, providing a large moment arm. In this way, even if the electrical connector 100 only comprises one mounting flange 130 to enable a compact system design, the connection between the first PCB 300 and the electrical connector 100 may have sufficient mechanical strength to withstand forces that might tend to unmount or damage connector 100.

Figure 2:
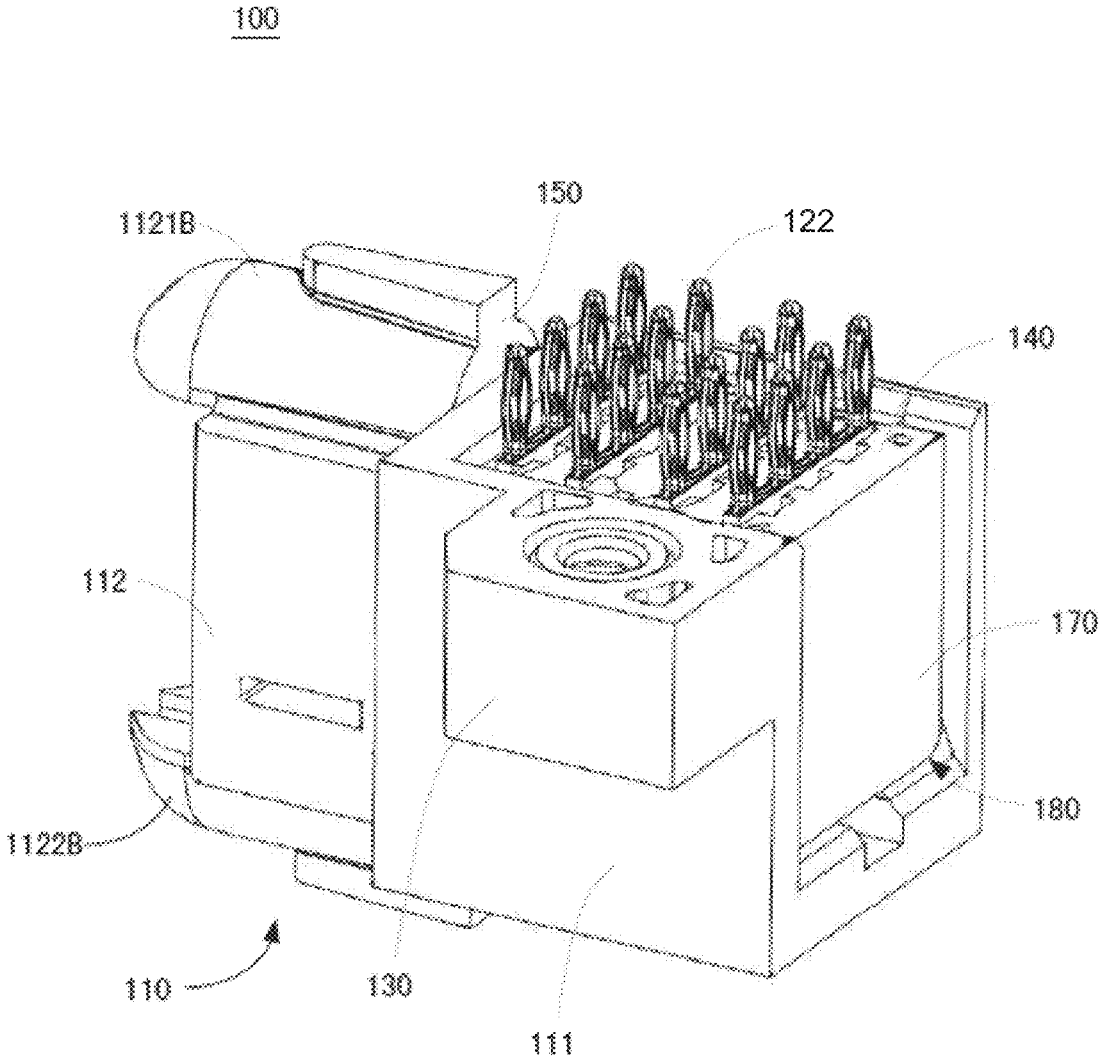
FIG. 2 is a three-dimensional drawing of the electrical connector of FIG. 1 viewed from a bottom face.
Figure 3:
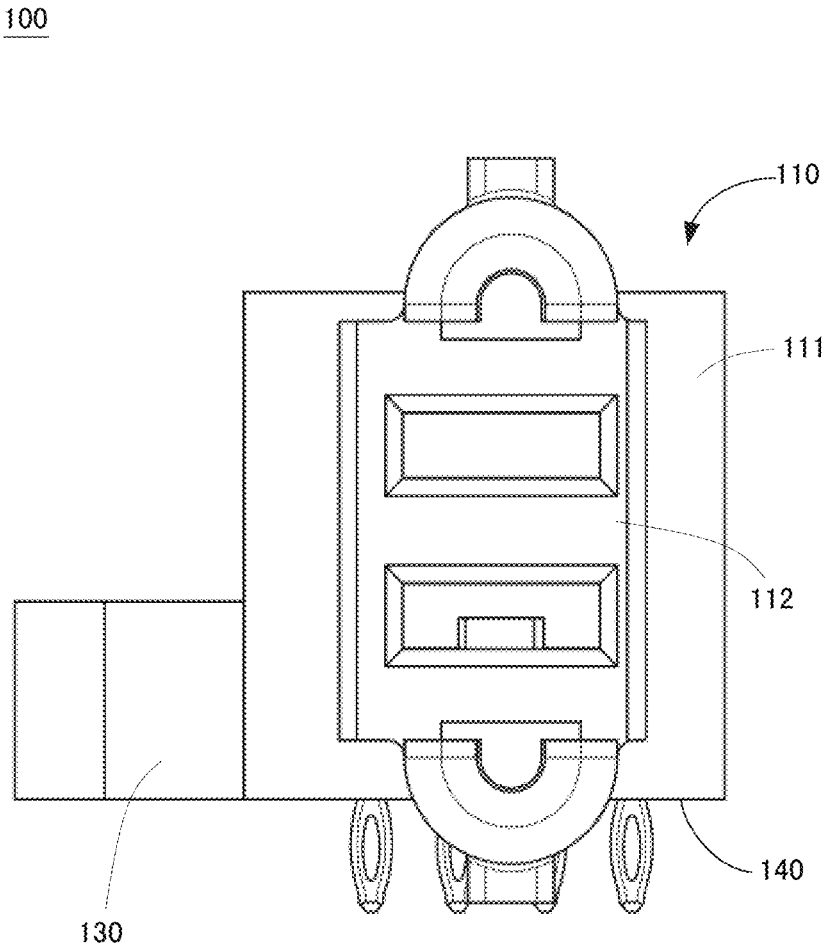
FIG. 3 is a front view of the electrical connector of FIG. 1.
Figure 4:
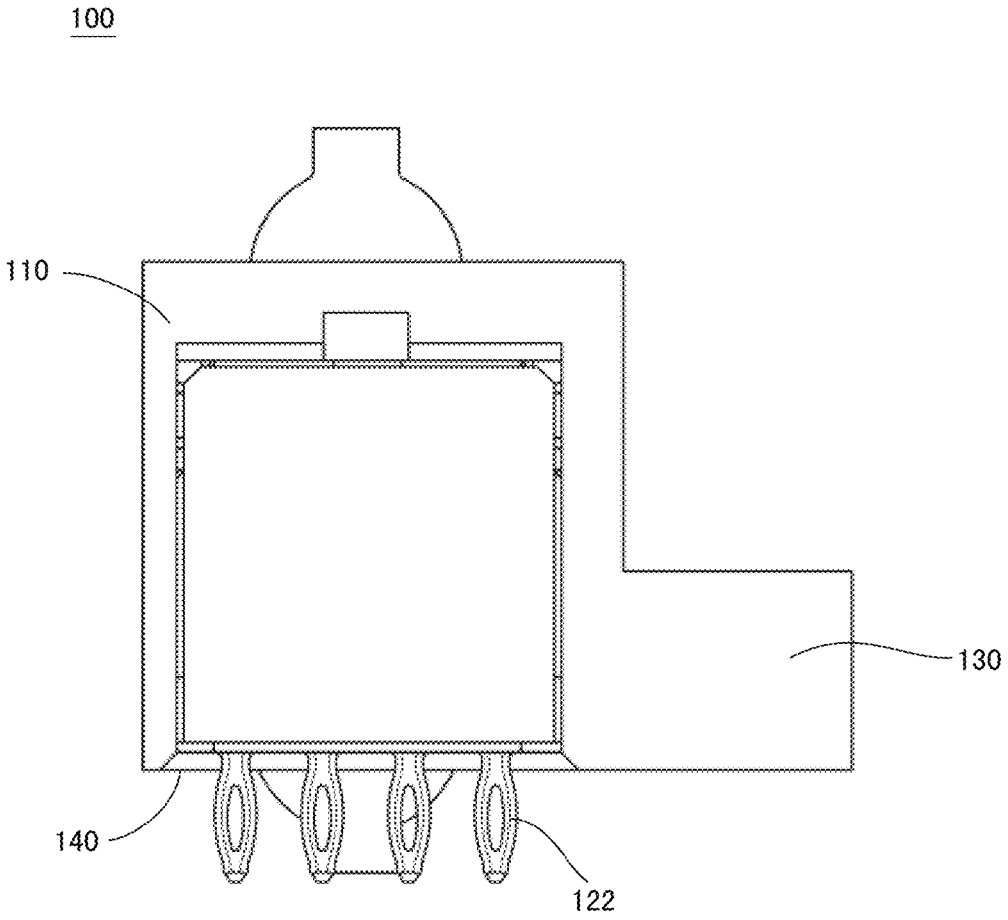
FIG. 4 is a rear view of the electrical connector of FIG. 1.
Figure 5:
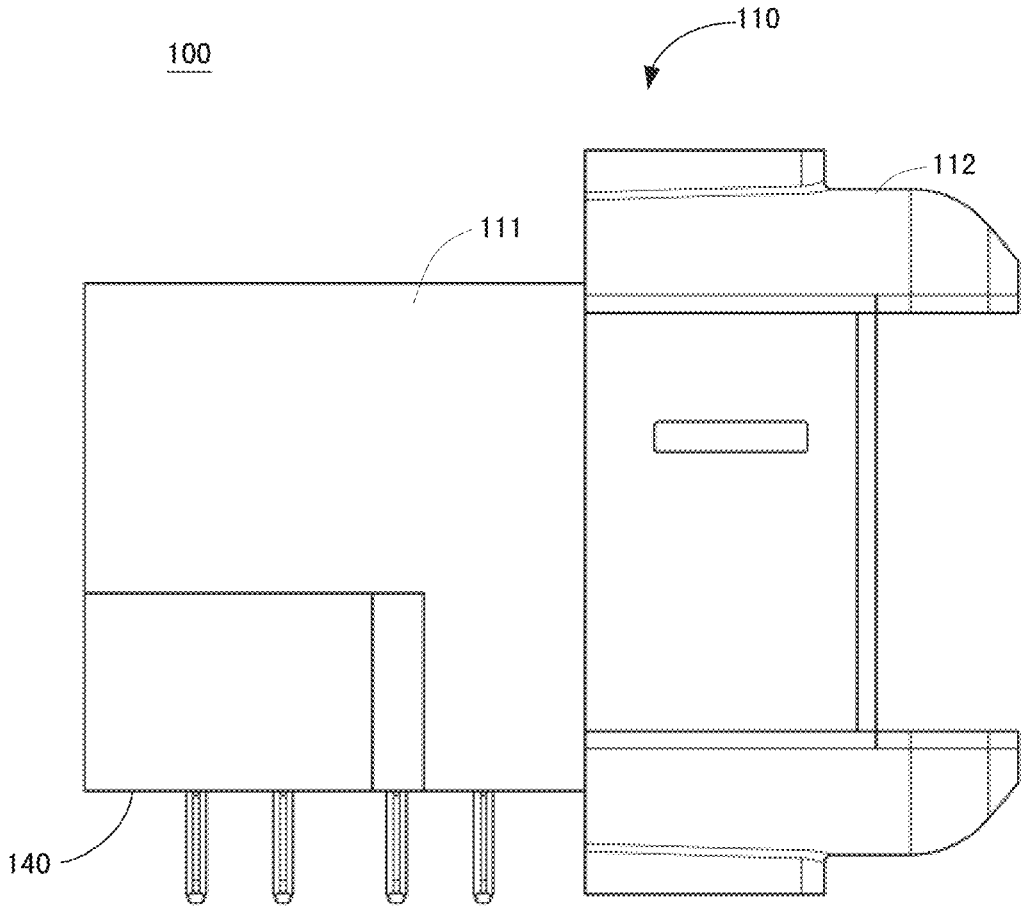
FIG. 5 is a left side view of the electrical connector of FIG. 1.
Figure 6:
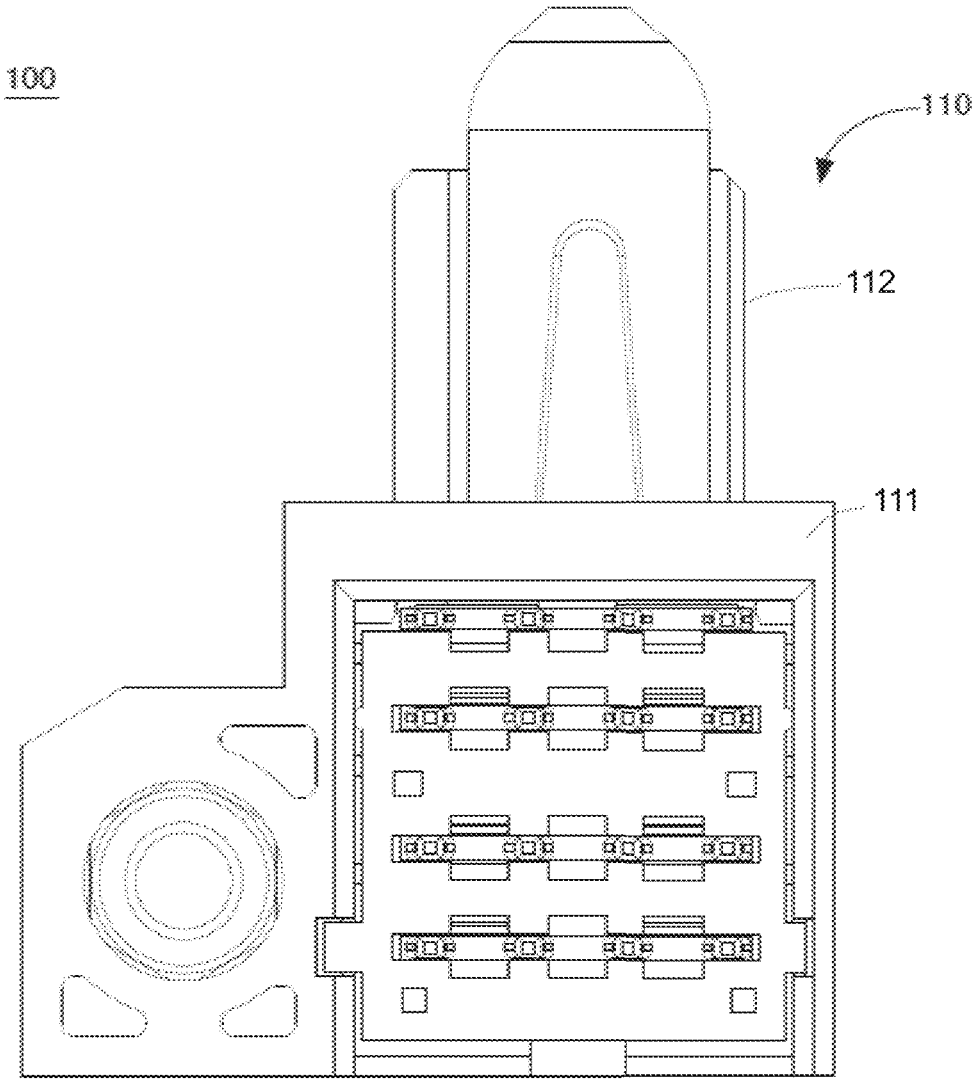
FIG. 6 is a bottom view of the electrical connector of FIG. 1.

In the illustrated embodiment above, in which the guiding parts 112B are disposed opposite one another in a pair on the receiving part 112A, the guiding parts 112B may comprise a first guiding part 1121B and a second guiding part 1122B, as shown in FIGS. 1 and 2. The first guiding part 1121B and the second guiding part 1122B are disposed opposite one another. The first guiding part 1121B may be disposed on the lower surface of the receiving part 112A, and the second guiding part 1122B is disposed on the upper surface of the receiving part 112A. The first guiding part 1121B projects beyond the mounting interface 140 of the insulating housing 110, as shown in FIG. 2, and the abutment surface 150 is disposed on the first guiding part 1121B. The first guiding part 1121B can limit motion of the electrical connector 100 relative to a PCB to which the connector is mounted.

Optionally, the interface part 112 of the insulating housing 110 further comprises a stabilizing part 112D, as shown in FIGS. 1, 7 and 9; the stabilizing part 112D is disposed on the guiding part 112B. In the illustrated embodiment, the stabilizing part 112D may be a protrusion extending substantially in an insertion direction in which the complementary electrical connector 200 is inserted into the electrical connector 100. In this example, the stabilizing part 112D gradually widens in the insertion direction. In other words, it has a smaller size at a near end relative to the complementary electrical connector 200 than at a remote end. Correspondingly, the complementary electrical connector 200 is provided with a stabilizing slot 230. Once the complementary electrical connector 200 and the electrical connector 100 have been matched and connected, the stabilizing slot 230 receives the stabilizing part 112D. The engagement of the stabilizing slot 230 with the stabilizing part 112D further aids the alignment of the two electrical connectors during the matching and connecting thereof. The interaction of these components can prevent the complementary electrical connector 200 and the electrical connector 100 from rotating relative to the other. Relative rotation of PCBs 300 and 400 is similarly resisted. In other embodiments, the stabilizing part 112D could have another structure, e.g. a groove, etc., as long as it is able to engage with a corresponding part on the complementary electrical connector 200.

Figure 8:
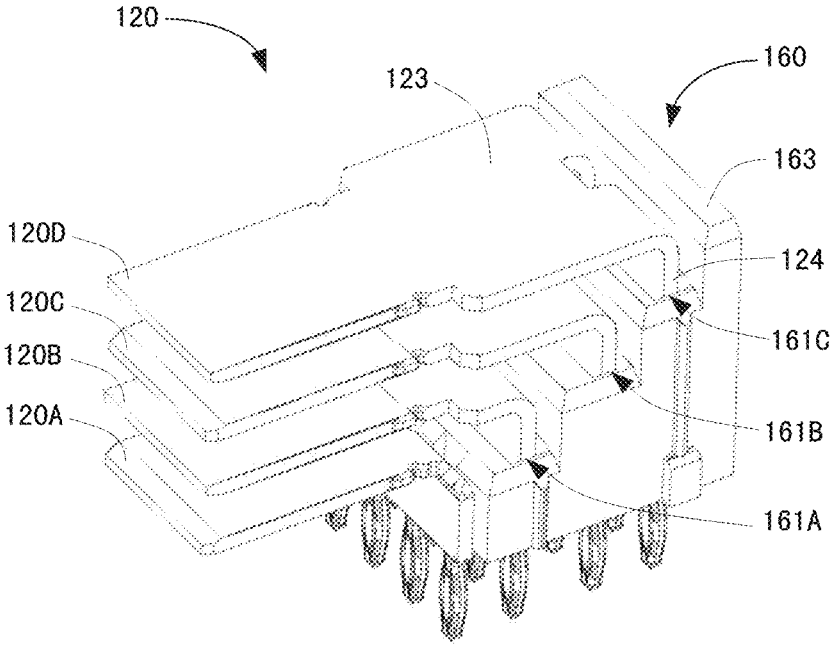
FIG. 8 is a three-dimensional drawing of a terminal subassembly in the electrical connector of FIG. 1, including electrically conductive terminals and an organizer.

In some embodiments, the electrical connector 100 may comprise an organizer 160, as shown in FIGS. 7-8. The organizer 160 has multiple insertion slots 161. The multiple insertion slots 161 are parallel to each other. One electrically conductive terminal of set 120 may be inserted in each insertion slot 161. In the embodiment shown in the figure, the multiple insertion slots 161 extend in a vertical direction. In this case, a vertical part of the electrically conductive terminals of set 120 (e.g. the second middle part 124) is inserted into the insertion slot 161. The insertion slots 161 are spaced apart, so that the electrically conductive terminals of set 120 are spaced apart. Optionally, the multiple insertion slots 161 may extend in a horizontal direction. In this case, a horizontal part of the electrically conductive terminals of set 120 (e.g. the first middle part 123) is inserted into the insertion slot 161.

The organizer 160 may be molded from an insulating material. The insulating material may be for example a plastic having glass fiber, to reinforce the strength of the plastic. The organizer 160 is used to fix the positions of the electrically conductive terminals 120 in the insulating housing 110. Furthermore, the organizer 160 also spaces adjacent electrically conductive terminals 120 apart from one another, so that adjacent electrically conductive terminals of set 120 are electrically insulated.

Preferably, parts of the electrically conductive terminals of set 120 which are close to the contact tail 122 are inserted into the corresponding insertion slots 161. The matching-connecting parts 121 of the electrically conductive terminals of set 120 extend into the sockets 112C of the interface part 112, and their positions are maintained by the sockets 112C. In this way, at the two ends of the electrically conductive terminals of set 120, the sockets 112C and the organizer 160 can be relied upon to maintain their relative positions in the insulating housing 110 respectively, hence a stable connection is formed. The contact tail 122 extend to the outside of the organizer 160, so as to be electrically connected to the first PCB 300.

In the embodiment shown in the figure, the electrical connector 100 comprises four electrically conductive terminals in set 120, and the organizer 160 is provided with three insertion slots 161. In other words, the number of insertion slots 161 may be one fewer than the number of electrically conductive terminals illustrated for set 120. In this case, a front end of the organizer 160 may be spaced apart from the insulating housing 110, in order to form a slot (not shown) between the organizer 160 and the insulating housing 110. The slot can clamp the foremost one of the electrically conductive terminals of set 120, e.g. the electrically conductive terminal 120A in FIG. 7. The structure of the organizer 160 can thereby be simplified, such that the electrical connector 100 becomes smaller and more compact.

Preferably, channels 164 are provided in a sidewall of the insertion slot 161, said sidewall being parallel to the electrically conductive terminals of set 120. The channels 164 may extend in the vertical direction. The channels 164 divide a large flat surface of the sidewall of the insertion slot 161 into a number of small flat surfaces. Compared with a large surface, a small flat surface is less affected by deformation in the organizer 160 during the molding of the organizer 160. In addition, having a number of small flat surfaces is more favorable for positioning the electrically conductive terminals of set 120 in the organizer 160, and the electrically conductive terminals of set 120 can be held better when the electrical connector 100 is mounted to the first PCB 300.

In order to be able to mount the electrically conductive terminals of set 120, or, in some alternative embodiments the electrically conductive terminals of set 120 and the organizer 160 as a subassembly, into the insulating housing 110, the insulating housing 110 has an opening 180 which extends from the mounting interface 140 to a rear face 170, as shown in FIG. 2. The opening 180 extends from a front end of the mounting interface 140 to a top end of the rear face 170. The rear face 170 of the insulating housing 110 is a face opposite the matching-connecting part.

In the embodiment shown in the figure, it is possible to first insert all of the electrically conductive terminals of set 120 into the insulating housing 110, and then insert the organizer 166 into the insulating housing 110 from the mounting interface 140 in an upward direction. In the process of inserting the organizer 160, it is ensured that each electrically conductive terminal of set 120 are inserted into the corresponding insertion slot 161, or inserted into the corresponding insertion slot 161 and the slit between the insulating housing 110 and the front end of the organizer 160. In order to retain the organizer 160 and the electrically conductive terminals 120 in the insulating housing 110, a side of the organizer 160 may be provided with a first limiting part 162, and a second limiting part (not shown) may be disposed in a corresponding position on an inner wall of the insulating housing 110. The first limiting part 162 and the second limiting part can engage with each other. In the embodiment shown in the figure, the first limiting part 162 extends in the vertical direction. In this example, the first limiting part 162 is a protrusion. Correspondingly, the second limiting part is a groove matched to the protrusion. In other embodiments which are not shown, the first limiting part 162 may be a groove, and correspondingly, the second limiting part may be a protrusion matched to the groove. When the organizer 160 is inserted into the insulating housing 110 in an upward direction, the first limiting part 162 is aligned with the second limiting part, and once the organizer 160 has been completely inserted into the insulating housing 110, the electrically conductive terminals 120 can be locked in the insulating housing 110.

Alternatively, in other embodiments, it is also possible to first insert the electrically conductive terminals of set 120 into the organizer 160, and then insert both as a single piece into the insulating housing 110 from behind. In this case, the first limiting part and the second limiting part may extend in the horizontal direction. The first limiting part is disposed horizontally at a side of the organizer 160; the second limiting part is disposed horizontally in a corresponding position on an inner wall of the insulating housing 110.

In the illustrated embodiment, the organizer 160 is stepped, with each insertion slot 161 being located on one step, as shown in FIGS. 7-8. The insertion slots 161 extend in the vertical direction. The size in the vertical direction of each insertion slot 161 is adapted to the size in the vertical direction of the second middle part 124 of the electrically conductive terminal 120 located in front of the insertion slot 161, and the contact tail projects to the outside of the insertion slot. In the embodiment shown in FIG. 8, the electrically conductive terminals 120A, 120B, 120C and 120D and insertion slots 161A, 161B and 161C are included. The insertion slot 161A has substantially the same height as the second middle part 124 of the electrically conductive terminal 120A in front thereof, i.e. the sizes in the vertical direction are adapted to each other. The insertion slot 161B has substantially the same height as the second middle part 124 of the electrically conductive terminal 120B in front thereof. The insertion slot 161C has substantially the same height as the second middle part 124 of the electrically conductive terminal 120C in front thereof. The organizer 160 is provided with a rear wall 163 behind the insertion slot 161C; the rear wall 163 has substantially the same height as the second middle part 124 of the electrically conductive terminal 120D, so that when they are fitted into the insulating housing 110, the rear wall 163 can have a sheltering and protecting action on them.

According to some embodiments of the present invention, an electrical connector assembly is also provided. The electrical connector assembly comprises any one of the electrical connectors described above and any one of the complementary electrical connectors described above.

According to other embodiments of the present invention, an electrical device is also provided. The electrical device comprises any one of the electrical connectors described above and an electronic component connected to the electrical connector (e.g. the first PCB).

According to other embodiments of the present invention, an electrical interconnection system is also provided. The electrical interconnection system comprises any one of the electrical connector assemblies described above, a first electronic component and a second electronic component. The first electronic component is electrically connected to the electrically conductive terminal of the electrical connector, and the second electronic component is electrically connected to the electrically conductive terminal of the complementary electrical connector.

In the description of the present invention, it must be understood that orientations or positional relationships indicated by orientation words such as "front", "rear", "up", "down", "left", "right", "transverse", "vertical", "perpendicular", "horizontal" and "top", "bottom" etc. are generally based on the orientations or positional relationships shown in the accompanying drawings, and are merely intended to facilitate description of the present invention and simplify description. In the absence of a statement to the contrary, these orientation words do not indicate or imply that the apparatus or element referred to must have a specific orientation or be constructed and operated with a specific orientation, and therefore must not be understood as restricting the scope of protection of the present invention; the orientation words "inner" and "outer" mean inner/outer relative to the outline of each component itself.

In order to facilitate description, relative spatial terms may be used here, such as "on top of . . . ", "above . . . ", "on an upper surface of . . . " and "upper", etc., for the purpose of describing a spatial positional relationship between one or more component or feature shown in the figures and another component or feature. It should be understood that spatial relative terms not only include the orientation of components as described in the figures, but also include different orientations in use or operation. For example, if a component in the accompanying drawings is inverted as a whole, then the component being "above another component or feature" or "on top of another component or feature" will include the case where the component is "below another component or structure" or "underneath another component or structure". Thus, the demonstrative term "above . . . " may include two orientations, specifically, "above . . . " and "below . . . ". In addition, these components or features may also be positioned at other different angles (e.g. rotated by 90 degrees or another angle); all such cases are intended to be included herein.

It must be noted that the terms used herein are intended merely to describe particular embodiments, not to restrict demonstrative embodiments according to the present application. If used herein, unless otherwise clearly indicated in the context, the singular form is also intended to include the plural form; in addition, it should also be understood that when the term(s) "include" and/or "comprise" is/are used herein, this shows clearly the existence of a feature, step, operation, component, assembly and/or a combination thereof.

It must be explained that the terms "first" and "second" etc. in the description and claims of the present application and the abovementioned accompanying drawings are used to distinguish between similar objects, and need not be used to describe a specific order of precedence or sequence. It should be understood that data used in this way can be exchanged in appropriate circumstances, in order that the embodiments of the present application described here can be implemented in a sequence other than those illustrated or described here.

The present invention has been explained by description of the illustrative embodiments above, but it should be understood that the embodiments above are merely intended to provide examples and explanations, not to restrict the present invention to the scope of the embodiments described. In addition, those skilled in the art will understand that the present invention is not limited to the embodiments above; further variations and amendments may be made according to the teaching of the present invention, and all such variations and amendments fall within the scope of protection claimed by the present invention. Therefore, the scope of protection of the present invention is defined by the attached claims.

What is claimed is:

1. An electrical connector configured for use in an electronic device with a direct connect orthogonal architecture, the electrical connector comprising:

an insulating housing comprising an interface part comprising a plurality of openings configured to receive mating contacts of a complementary electrical connector mated to the electrical connector therein, wherein the plurality of openings are separated in a first direction;

at least one electrically conductive terminal, with at least a part of each of the at least one electrically conductive terminal being accommodated in the insulating housing; and a mounting flange, connected to the insulating housing outside the insulating housing, the mounting flange comprising a mounting hole configured for mounting the electrical connector to an electronic component, wherein the mounting flange extends from the insulating housing in a second direction that is orthogonal to the first direction.

2. The electrical connector as claimed in claim 1, further comprising a nut disposed in the mounting hole.

3. The electrical connector as claimed in claim 1, wherein the electrical connector has a single mounting flange.

4. The electrical connector as claimed in claim 1, wherein the mounting flange is disposed at a side configured to align with a printed circuit board to which a complementary electrical connector, mated to the electrical connector, is mounted.

5. An electrical connector, comprising:

an insulating housing;

at least one electrically conductive terminal, with at least a part of each of the at least one electrically conductive terminal being accommodated in the insulating housing; and a mounting flange, connected to the insulating housing outside the insulating housing, the mounting flange comprising a mounting hole configured for mounting the electrical connector to an electronic component, wherein:

each of the at least one electrically conductive terminals has a mating contact portion and a contact tail, which extend in mutually perpendicular directions and are located at two ends of the electrically conductive terminal respectively; and the contact tail extends to the outside of the insulating housing through a face of the insulating housing comprising a mounting interface.

6. The electrical connector as claimed in claim 5, wherein an axial direction of the mounting hole is parallel to a direction of extension of the contact tail.

7. The electrical connector as claimed in claim 5, wherein the contact tail has elasticity, and can be compressed when connected to the electronic component, in order to connect the contact tail to the electronic component in a press-fitted manner.

8. The electrical connector as claimed in claim 5, wherein the mounting flange is flush with the mounting interface, and the mounting hole is perpendicular to the mounting interface.

9. The electrical connector as claimed in claim 5, wherein the electronic component is a printed circuit board, and wherein:

the insulating housing comprises a main body part and an interface part connected to the main body part; and the mating contact portion is accommodated in the interface part, the mounting interface is disposed on the main body part, and the interface part projects beyond the mounting interface, and is configured to abut an edge of the printed circuit board to which the electrical connector is mounted.

10. The electrical connector as claimed in claim 9, wherein the interface part of the insulating housing comprises:

a receiving part, provided with a socket, the mating contact portion extending into the socket, and the socket is configured to receive a mating contact portion of a complementary electrical connector mated to the electrical connector; and a guiding part, disposed on the receiving part and configured to guide the complementary electrical connector during connection.

11. The electrical connector as claimed in claim 10, wherein:

the guiding part comprises a first guiding part and a second guiding part disposed opposite each other on the receiving part; and the first guiding part projects beyond the mounting surface of the insulating housing, and is configured to engage the electronic component to which the electrical connector is mounted.

12. The electrical connector as claimed in claim 10, wherein the interface part of the insulating housing further comprises a stabilizing part disposed on the guiding part.

13. The electrical connector as claimed in claim 5, wherein the insulating housing has an opening, which extends from the mounting surface to a face opposite the mating contact portions, configured to receive the at least one electrically conductive terminal through the opening.

14. An electrical connector, comprising:

an insulating housing;

at least one electrically conductive terminal, with at least a part of each of the at least one electrically conductive terminal being accommodated in the insulating housing; and a mounting flange, connected to the insulating housing outside the insulating housing, the mounting flange comprising a mounting hole configured for mounting the electrical connector to an electronic component, wherein the electrical connector further comprises an organizer, the organizer having multiple insertion slots which are parallel to each other, with one electrically conductive terminal being inserted in each of the multiple insertion slots.

15. The electrical connector as claimed in claim 14, wherein a slot is disposed between a front end of the organizer and the insulating housing, and the slot clamps a foremost one of the at least one electrically conductive terminals.

16. The electrical connector as claimed in claim 14, wherein a part, close to the contact tail part, of the electrically conductive terminal is inserted into the corresponding insertion slot.

17. The electrical connector as claimed in claim 14, wherein each of the at least one electrically conductive terminals further comprises a first middle part connected to the mating contact portion, and a second middle part connected to the contact tail; the first middle part and the second middle part are connected to each other perpendicularly, so that the mating contact portion and the contact tail extend in mutually perpendicular directions.

18. The electrical connector as claimed in claim 17, wherein:

the organizer is stepped, with each insertion slot being located on one step;

the size of each insertion slot is adapted to the size of the second middle part of the electrically conductive terminal located in front of the insertion slot; and the contact tail projects to the outside of the insertion slot.

19. The electrical connector as claimed in claim 14, wherein:

a side of the organizer is provided with a first limiting part, and a second limiting part is disposed on an inner wall of the insulating housing; and the first limiting part is engaged with the second limiting part.

20. The electrical connector as claimed in claim 14, wherein each of the multiple insertion slots is provided with a channel on a sidewall parallel to the at least one electrically conductive terminal.

21. An electronic device with a direct-connect orthogonal architecture, comprising:

a first electronic component and a second electronic component;

a first electrical connector mounted to the first electronic component, the first electrical connector comprising:

an insulating housing;

at least one electrically conductive terminal, with at least a part of each of the at least one electrically conductive terminal being accommodated in the insulating housing; and a mounting flange, connected to the insulating housing outside the insulating housing, the mounting flange comprising a mounting hole aligned with a hole in the first electronic component; and a second electrical connector mated to the first electrical connector, wherein the second electrical connector is mounted to the second electronic component;

wherein an edge of the first electronic component is adjacent to and orthogonal to an edge of the second electronic component.

22. The electronic device as claimed in claim 21, wherein the second electronic component is a printed circuit board, and wherein the mounting flange is disposed at a side configured to align with the printed circuit board to which the second electrical connector, mated to the first electrical connector, is mounted.

23. The electronic device as claimed in claim 21, wherein each of the at least one electrically conductive terminals has a mating contact portion and a contact tail, which extend in mutually perpendicular directions and are located at two ends of the electrically conductive terminal respectively; and wherein the contact tail extends to the outside of the insulating housing through a face of the insulating housing comprising a mounting interface.

24. The electronic device as claimed in claim 23, wherein the contact tail has elasticity, and can be compressed when connected to the first electronic component, in order to connect the contact tail to the first electronic component in a press-fitted manner.

25. The electronic device as claimed in claim 23, wherein the mounting flange is flush with the mounting interface, and the mounting hole is perpendicular to the mounting interface.

26. The electronic device as claimed in claim 23, wherein the first electronic component is a printed circuit board, and wherein:

the insulating housing comprises a main body part and an interface part connected to the main body part; and the mating contact portion is accommodated in the interface part, the mounting interface is disposed on the main body part, and the interface part projects beyond the mounting interface, and is configured to abut an edge of the printed circuit board to which the first electrical connector is mounted.

27. The electronic device as claimed in claim 26, wherein the interface part of the insulating housing comprises:

a receiving part, provided with a socket, the mating contact portions extending into the socket, and the socket is configured to receive a mating contact portion of the second electrical connector mated to the electrical connector; and a guiding part, disposed on the receiving part and configured to guide the second electrical connector during connection.

28. The electronic device as claimed in claim 27, wherein:

the guiding part comprises a first guiding part and a second guiding part disposed opposite each other on the receiving part; and the first guiding part projects beyond the mounting surface of the insulating housing, and is configured to engage the printed circuit board to which the first electrical connector is mounted.

29. The electronic device as claimed in claim 27, wherein the interface part of the insulating housing further comprises a stabilizing part disposed on the guiding part.

30. The electronic device as claimed in claim 27, wherein:

the guiding part comprises a first guiding part and a second guiding part disposed opposite each other on the receiving part;

the socket is a first socket;

the interface part of the insulating housing comprises a plurality of sockets, including the first socket and a second socket; and the first socket and the second socket are spaced apart along a line extending in a first direction; and the mounting flange extends from the insulating housing in a second direction, orthogonal to the first direction.

31. The electronic device as claimed in claim 30, wherein:

the first guiding part and the second guiding part are spaced apart along the line extending in the first direction; and the plurality of sockets are disposed between the first guiding part and the second guiding part.

32. The electrical connector as claimed in claim 1, wherein each of the at least one electrically conductive terminals has a mating contact portion and a contact tail, which extend in mutually perpendicular directions and are located at two ends of the electrically conductive terminal respectively.

* * * * *